US008434501B2

(12) United States Patent
Curtin

(10) Patent No.: US 8,434,501 B2
(45) Date of Patent: May 7, 2013

(54) SEALED CLEANER-BOX WITH MAGNETICALLY COUPLED ACTUATOR PUCKS

(75) Inventor: Mark Curtin, Kaneohe, HI (US)

(73) Assignee: Transition Automation, Inc., Tyngsboro, MA (US)

( * ) Notice: Subject to any disclaimer, the term of this patent is extended or adjusted under 35 U.S.C. 154(b) by 499 days.

(21) Appl. No.: 12/751,394

(22) Filed: Mar. 31, 2010

(65) Prior Publication Data

US 2010/0275956 A1 Nov. 4, 2010

Related U.S. Application Data

(60) Provisional application No. 61/165,201, filed on Mar. 31, 2009.

(51) Int. Cl.
*B08B 3/02* (2006.01)

(52) U.S. Cl.
USPC ..... 134/104.2; 134/50; 134/88; 134/94.1; 134/95.1; 134/95.2; 134/95.3; 134/103.2; 134/103.3; 134/104.4; 134/109; 134/114; 134/167 R; 134/172; 134/175; 134/177; 134/198; 134/200

(58) Field of Classification Search ..... 134/50, 134/88, 94.1, 95.1–95.3, 103.2, 103.3, 104.2, 134/104.4, 109, 114, 167 R, 172, 175, 177, 134/198, 200
See application file for complete search history.

(56) References Cited

U.S. PATENT DOCUMENTS 4,993,199 A * 2/1991 Hughes ..... 451/88
5,095,925 A * 3/1992 Elledge et al. ..... 134/61
5,107,876 A * 4/1992 Ozyjiwsky ..... 134/111
5,143,102 A * 9/1992 Blaul ..... 134/58 R
5,301,701 A * 4/1994 Nafziger ..... 134/95.2
5,704,381 A * 1/1998 Millan et al. ..... 134/102.2
6,585,943 B1 * 7/2003 Sanford et al. ..... 422/307
7,905,239 B2 * 3/2011 Kim ..... 134/95.2
8,225,804 B2 * 7/2012 Publ ..... 134/84
2002/0170579 A1 * 11/2002 Lammert et al. ..... 134/33
2007/0199578 A1 * 8/2007 Nomura et al. ..... 134/1
2008/0072927 A1 * 3/2008 Weiss ..... 134/10
2009/0133721 A1 * 5/2009 Campbell ..... 134/19

* cited by examiner

*Primary Examiner* — Arlen Soderquist
(74) *Attorney, Agent, or Firm* — Gesmer Updegrove LLP

(57) ABSTRACT

A cleaning system which includes an enclosure and having a door with a transparent window. The door is opened and closed to load and unload products to be cleaned. An operator puck on the outside of the enclosure couples magnetically to another actuator puck on the inside of the enclosure. This coupling allows an operator to move and direct the inside puck to actuate spray or air blast functions, without opening the enclosure. The outside operator puck includes one or more switches which turn on the various electronic components such as the liquid pump, light, or air blast valve. The cleaning system enables a user to efficiently direct cleaning action to parts inside to minimize the cleaning time, and to prevent exposure of chemicals. The cleaning fluid is cycled out of the enclosure continuously, and into a "trap" box, through a pump and back into the cleaner box in a closed loop cycle. This system reduces exposure of users to cleaning chemicals and their vapors prevent the chemicals from being deposited into the environment.

8 Claims, 3 Drawing Sheets

SEALED CLEANER-BOX WITH MAGNETICALLY COUPLED ACTUATOR PUCKS

PRIORITY INFORMATION

This application claims the benefit of U.S. Patent Application Ser. No. 61/165,201 filed on Mar. 31, 2009, all of which is incorporated herein in its entirety.

BACKGROUND OF THE INVENTION

1. Field of the Invention

The invention relates to the field of cleaning systems, and in particular to a system comprised of a sealed enclosure having a transparent door such that a pair of magnetically coupled pucks enables an operator to move and direct a flow of cleaning fluid to clean objects located within the enclosure.

2. Description of the Prior Art

There is an increasing concern with regard to the effects of hazardous materials on the environment. So one needs to be concerned any time potentially hazardous materials are being used in any process. That includes materials which may be hazardous to humans or other animals or to the environment.

There is a trend and value in current manufacturing operations to remove any chemical exposure and loss and waste during manufacturing operations. One area in particular: cleaning of electronics assemblies and tools used in electronics assemblies is the focus of concern. Many systems used for cleaning contain solvents such as alcohol, or other cleaning agents and these fluids often become contaminated with the materials they are used to clean such as solder paste. There is a need to keep operators separate from these cleaning materials, during the cleaning process, and also, there is a need to keep the cleaning materials confined as much as possible, so that they do not become a vapor in the manufacturing operation, where they can be breathed by humans, or where they can make contact with people.

Most such cleaning systems involve closed automatic spray operations that are inefficient because they apply aggressive cleaning action to entire areas even if the objects to be cleaned are only small, or if the areas to be cleaned are confined to a small area. Other systems involve placing objects in tanks with open covers, which enable operators to spray and view the contaminated objects, however, because these systems are generally vertical tanks to contain the cleaning fluid and draining fluid, the visibility is limited by looking down vertically. This does not offer an desirable arrangement for operators, because the tanks are large and the operators often have to stand on step stools and look into the tank. While these systems offer more efficiency by allowing spot cleaning, they are still not optimal. They also allow the operators to be exposed to the chemicals being used and cleaned.

SUMMARY OF THE INVENTION

An object of the present invention is to provide a sealed cleaning enclosure where two magnetically coupled pucks are positioned flush with the transparent window of the enclosure, one on the outside, and one on the inside. In the present embodiment, the inside puck is configured to spray a cleaning fluid, or to blast compressed air at the objects to be cleaned. In other configurations, the system could have a cleaning fluid puck, an air blast puck and a rinse fluid puck. The term "puck" is used, because both the outside puck and the inside puck are fitted with ball bearings which allow each puck to roll with very little friction on the surface of the transparent windows.

This minimizes friction and also scratching which might occur if the pucks were simply sliding on the surface of the transparent windows. The system of the present invention also includes a light to highlight and illuminate the area being cleaned. Each liquid may be contained in its own separate feed tank also called a "trap". Also, all liquid and air blast functions could be consolidated into one "puck" inside the cleaner box, or could be handled by three separate pucks which could be alternatively parked and/or coupled with the outside actuator puck.

A further object is to provide a sealed environment to keep the cleaning materials from contaminating the environment or coming into human contact.

Briefly, according to an embodiment of the present invention, the system includes an enclosure, with a door having a transparent window. The door includes a rubber seal and toggle latch which keeps the door closed during the cleaning cycle. Electronic switches, a power supply, an air valve, a fluid pump and a power supply are all contained in an "electronic control box" and serve to provide the needed 12V power to the pump, the light, or activate the air valve for air blasting operations. A second liquid tight box is used as a reservoir and trap to collect and transfer liquid that drains from the cleaning enclosure—and to transfer it to the pump and out to the spray puck inside the enclosure. Tubes transfer the liquid from the enclosure to the trap, and from the trap to the pump, and finally from the pump to the spray puck inside the cleaning enclosure. An actuator puck is moved by an operator on the outside of the transparent window of the enclosure, which in turn moves the inside spray puck thereby directing the cleaning action to the area inside the box where cleaning is needed.

These and other objects, features and advantages of the present invention will become apparent in light of the following detailed description of preferred embodiments thereof, as illustrated in the accompanying drawings.

BRIEF DESCRIPTION OF THE DRAWINGS

The invention may be further understood with reference to the accompanying drawings in which.

DETAILED DESCRIPTION OF THE INVENTION

This apparatus was developed as a way to remove solder paste from squeegee blades and stencils but may also be useful for other industries such as cleaning surgical tools in the medical field or removing pesticides in the food processing industry. The invention has a specific function of segregation which has valuable utility in any manufacturing or mining activity where materials need to be separated, and any of the components or materials are valuable (need to be recycled) or are hazardous (need to be contained and separated from humans).

For example, it is common to use both silver loaded epoxies in the manufacturing of solar cells, and often, the stencils or misprinted substrates need to be cleaned. It is important to collect the residual silver loaded epoxy to recycle the silver that is collected. The present invention offers a closed system that allows for the entrapment and collection of the valuable silver. The equipment offers a unique way to clean soiled or contaminated tools or products, without spreading the contaminated materials during the cleaning process. The system may also be used to keep the cleaned tools/products hygienic and thus uncontaminated from bacteria outside the system.

The system may be configured with multiple liquid cleaners, each containing their own pump and trap. For example, in some cases a strong solvent may be desired for cleaning, and then a second rinse liquid may be desired to remove the caustic or strong concentration of solvent, prior to an operator opening the system. The air blast function may also be used to force fumes out of the enclosure into a vent so that when the operators open up the enclosure, there is a very minor or nil amount of solvent left in the enclosure thereby eliminating exposure of the chemicals involved to the human operators.

Figure 1:
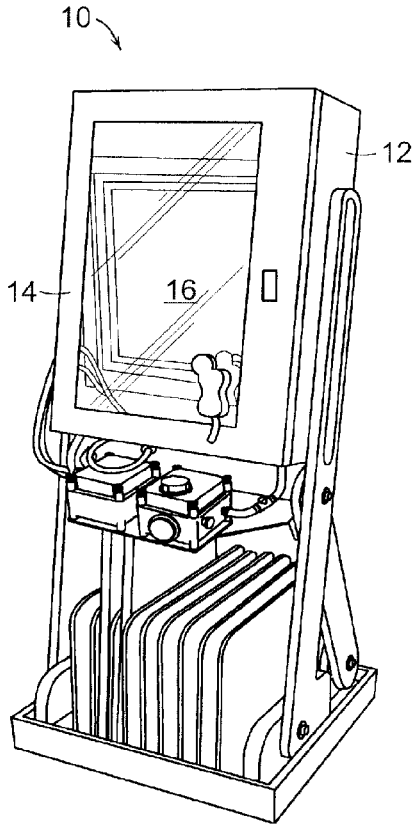
FIG. 1 illustrates a cleaner box of the invention.

As initially seen in FIG. 1, the cleaning system 10 includes the cleaning enclosure 12 which has a door 14 with a transparent window 16. The door is opened and closed to load and unload products to be cleaned. An operator puck 26 on the outside of the enclosure 12 couples magnetically to another actuator puck 28 on the inside of the enclosure. This coupling allows an operator 30 to move and direct the inside puck to actuate spray or air blast functions, without opening the enclosure. The outside operator puck includes one or more switches which turn on the various electronic components such as the liquid pump, light, or air blast valve. The cleaning system enables a user to efficiently direct cleaning action to parts inside to minimize the cleaning time, and to prevent exposure of chemicals.

The cleaning fluid can be fed into the enclosure from the outside through fluid tight connections 32, 34. The cleaning fluid is cycled out of the enclosure continuously, and into a "trap" box 24, through a pump and back into the cleaner box in a closed loop cycle. A feature of this system is that at rest, the cleaning fluid naturally drains into the "trap" box. This trap box can be easily disconnected and transported to a safe area to allow for the separation of solids and liquids which reside in the "trap" box.

The tubes connecting the trap to the drain of the enclosure and the pump contain quick connections that close the tube when disconnected. This is important so that no material leaks when the trap is disconnected for servicing. The actual cleaning area of this cleaning enclosure generally remains free of cleaning fluid during the opening of the box for parts entering and removal, which is different from other systems which usually have cleaner fluid present when parts are entering and being removed. This difference reduces exposure of users to cleaning chemicals and their vapors.

Figure 2:
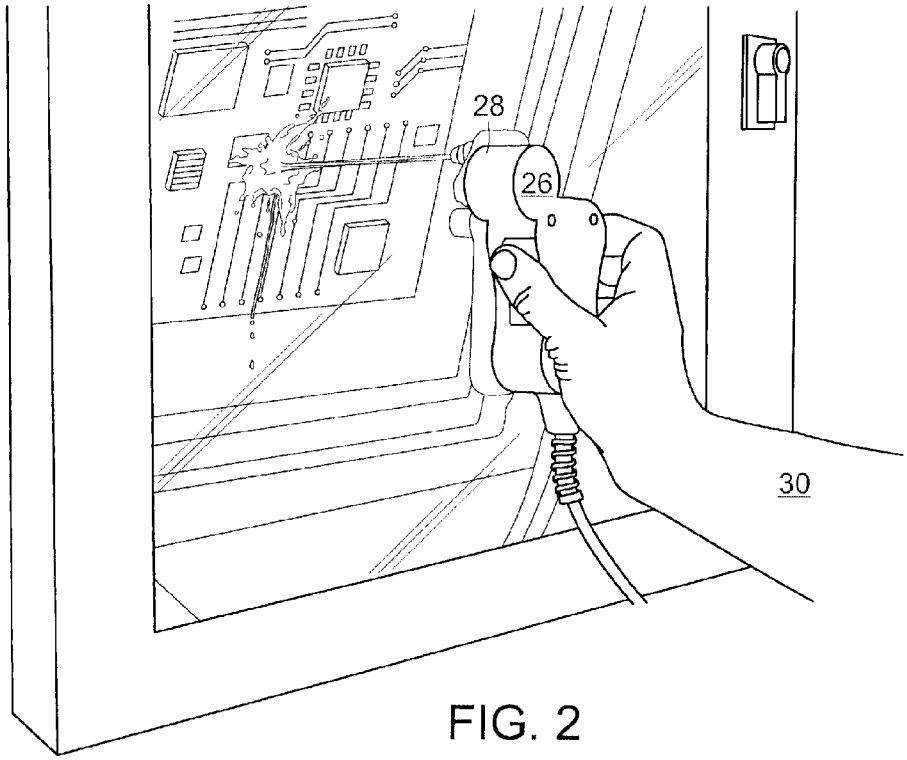
FIG. 2 is an illustrative view showing a person operating the system.
Figure 3:
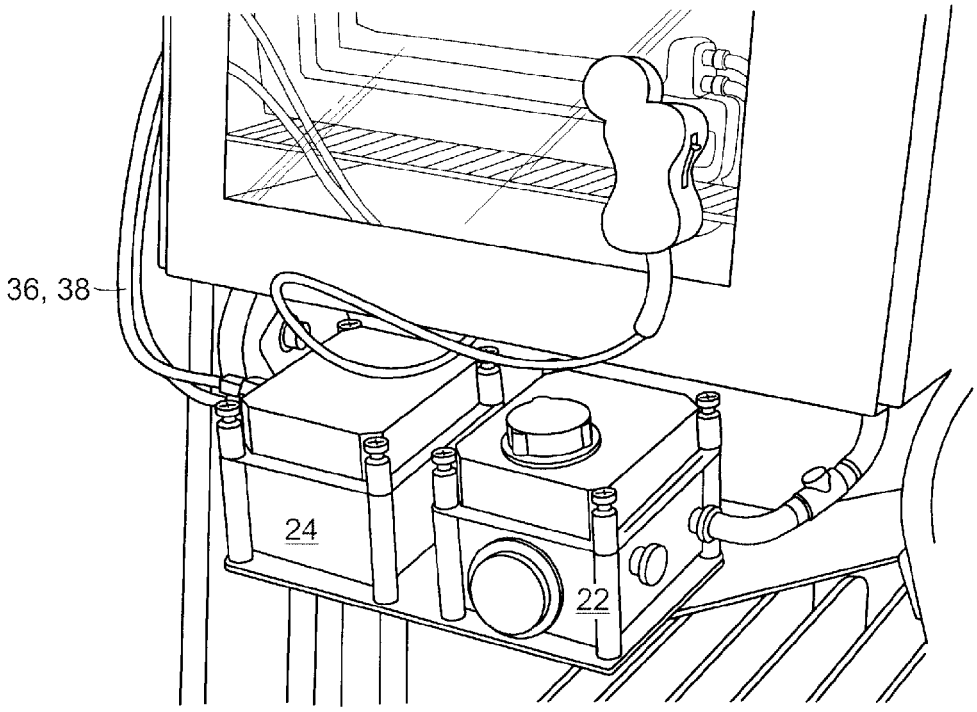
FIG. 3 is an illustrative view of an electronic control box and trap.
Figure 4:
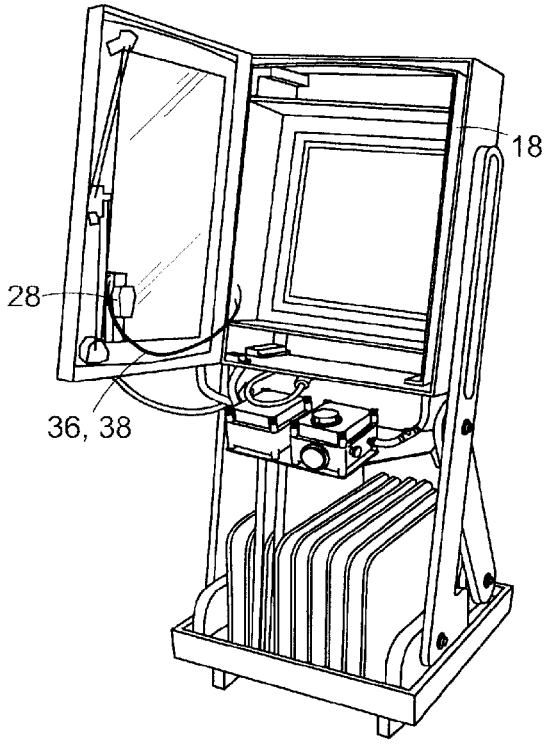
FIG. 4 is an illustrative view of the cleaning box of FIG. 1 with the door of the box open.
Figure 6:
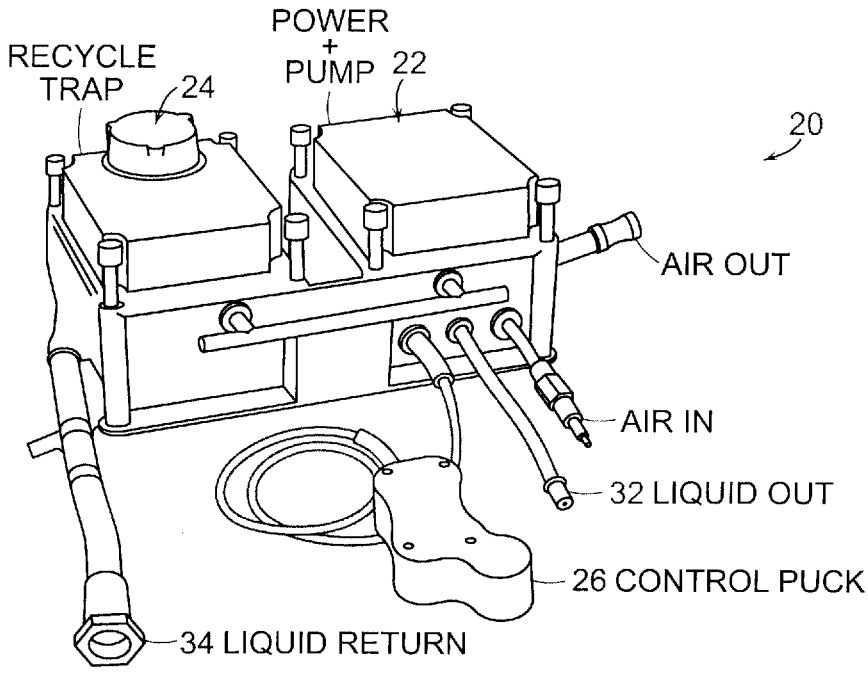
FIG. 6 is a rear view of the electronic control box and trap.

The cleaning system or enclosure includes a housing and a cover, which is preferably clear. The door may magnetically seal or close with toggle latches to keep the door closed and locked. A gasket seal 18 prevents leakage between the door and the enclosure. The removable service pack 20, also shown in FIGS. 3 and 6 includes a power source and pump 22 and a recycle trap 24. A control puck 26 is magnetically connected to an actuator puck 28 on the inside of the cover. An operator 30, as seen in FIG. 2 then moves the connected set of pucks to direct the flow of cleaning fluid and/or air flow to clean the dirty tools. This system is unique in allowing an operator to move and direct spray action very near to his visual and dexterous range of motion, without any risk of materials spraying back to affect his breathing or to make contact with his skin.

As this enclosure was originally designed to clean solder paste from printing tools used in the electronic industry, some of the descriptions are focused in that area, even though the system may be used in other industries. Many different types of objects can be held inside the enclosure including a solder paste stencil, misprinted printed circuit boards, spatulas, or closed printing heads. The operator puck is movable along the cover of the enclosure. Each actuator puck may have at least one magnet which couple with an operator puck that is manipulated by an operator. The term "couple" is used here and has the meaning that when the operator puck is moved close to the actuator puck, the two pucks grab each other magnetically, and any further movement of the operator puck causes the actuator puck inside the enclosure to follow all movements. There is a coupling force of 1.5 lbs, which allows for spray and movement acceleration forces be opposed so that the inside actuator puck does not decouple from the outside operator puck.

Figure 5:
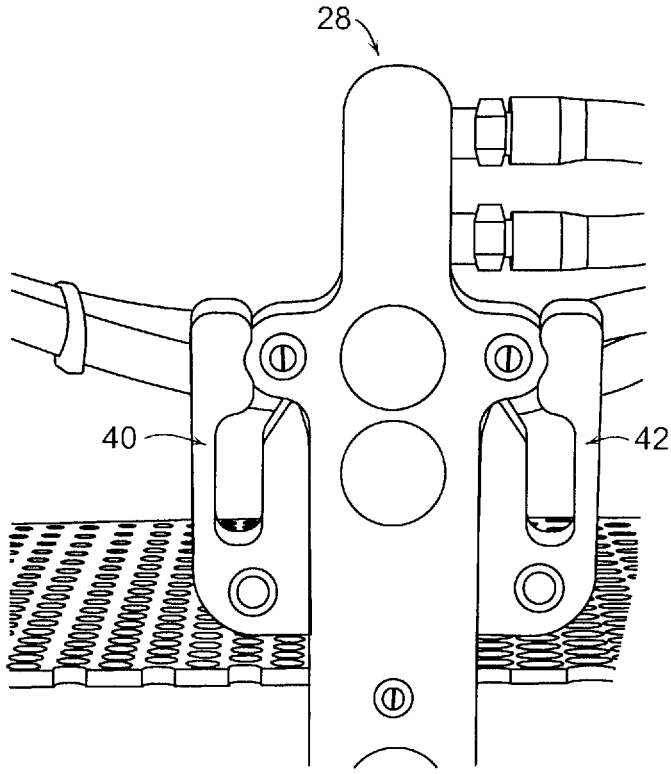
FIG. 5 is an illustrative view of magnetically coupled pucks.

The inside actuator puck has one or more tubes 36, 38 leading to it which feed the fluid or air used in the cleaning. The operator puck slides on the outside of the transparent door window, and as the puck moves the actuator puck inside moves along with it. Thus the operator controls the movement of the actuator puck inside the enclosure. The magnetic coupling of an operator puck and various actuator pucks inside the enclosure give operators a lot of control and functionality, without exposing them to the chemicals inside the enclosure. Alternatively, multiple functions may be combined into a single puck. To prevent the inside pucks from falling free if they are "decoupled" from the outside puck, there are snap nests 40, 42 as shown in FIG. 5 which allow the operator to move the operator puck and actuator puck and slide and lock the actuator puck so that it remains tucked against the window, and in position so that it could be coupled again, and un-snapped and moved about. The snap nest allows the inside puck to travel out in one direction only, and is retained in all other dimensions so that it does not fall.

The operator puck contains magnets, which extend a magnetic field through the cleaner enclosure's clear window. This magnetic field couples to magnets attached to the actuator puck inside the box. The operator puck contains one or more switches which turn on the various spray(s) or air blast actions of the inside actuator puck. The operator simply holds the puck and moves it around and presses the switch to activate the desired cleaning action inside the enclosure.

The operator puck has a hand activated switch that leads to a pump inside the electronic control box, which circulates the fluid from a sloped drain region to the trap, through the pump and back to the spray head puck. Additional switches for activating an air blast or other liquid spray could also be added to the operator puck.

All of the spray and cleaning material is maintained within an external trap box thus preventing contamination of the areas outside the box, and leaving the inside of the box drained and clear of cleaned materials. The invention allows spraying and movement of cleaning tools without the spray fluid or the cleaned materials from escaping and contaminating outside areas.

This type of cleaning or cleaning box may be extremely useful especially for applications where the liquid or powder cleaners are hazardous to humans or the environment and thus can be manipulated/sprayed and drained without contamination to outside areas.

A catch basin is used to collect solids or particles which may be washed off the cleaned products. The system can be can be automated or have hand activated switches depended on the expense of the system. Another advantage of this system is that it is portable.

Although the present invention has been shown and described with respect to several preferred embodiments thereof, various changes, omissions and additions to the form and detail thereof, may be made therein, without departing from the spirit and scope of the invention. For example, depending on the type of fluid being used one might add a heater or warming device to enhance the material flow through the box and enhance the cleaning capability of the fluid.

What is claimed is:

1. A cleaning system to clean objects, said cleaning system including a cleaning enclosure comprising:

a housing having a bottom, four walls and an opening;

a door which is maneuverable into an open and a closed position over the opening of the housing wherein said door includes a transparent window;

a power supply;

a supply of at least one cleaning fluid;

an actuator puck on the inside cover;

a pumping mechanism to form a flow of the cleaning fluid via a conduit from the supply to the actuator puck;

an operator puck on the outside cover, wherein the two pucks are magnetically connected on each side of said transparent window such that an operator can move the set of magnetically connected pucks around to control the flow of cleaning fluid sprayed from the actuator puck toward the objects inside the enclosure such that the objects are cleaned by the flow of cleaning fluid.

2. The cleaning system of claim 1, wherein said supply provides at least two cleaning fluids.

3. The cleaning system of claim 2, wherein one of the cleaning fluids is air.

4. The cleaning system of claim 1, wherein the operator puck includes a light.

5. The cleaning system of claim 1, wherein the used cleaning fluid flows into a trap positioned at the underside of the cleaning enclosure.

6. The cleaning system of claim 1, wherein the cleaning system provides a closed loop cycle for the cleaning fluid that begins and ends outside of the cleaning enclosure.

7. The cleaning system of claim 1, wherein the actuator and operator pucks are fitted with ball bearing to allow them to roll along the surfaces of the transparent window.

8. The cleaning system of claim 1, wherein tubes transfer the cleaning fluid from the supply to a sprayer in the actuator puck.

* * * * *